US005772529A

United States Patent [19]

Ruth, Jr.

[11] Patent Number: 5,772,529

[45] Date of Patent: Jun. 30, 1998

[54] GOLF CLUB HAVING ENLARGED HEAD DESIGN FORMED FROM RIGID MESH MATERIAL

[76] Inventor: Thomas L. Ruth, Jr., 65731 E. Rolling Hills Dr., Tucson, Ariz. 85739

[21] Appl. No.: 845,880

[22] Filed: Apr. 28, 1997

[51] Int. Cl.[6] ..... A63B 53/04

[52] U.S. Cl. ..... 473/327; 473/345; 473/329; 473/524; 473/563; 473/409

[58] Field of Search ..... 473/329, 330, 473/332, 331, 219, 226, 223, 228, 524, 327, 559, 560, 561, 562, 563, 528, 507, 513, 514, 515, 509, 409

[56] References Cited

U.S. PATENT DOCUMENTS

| | | | |
|---|---|---|---|
| D. 194,044 | 11/1962 | De Angelo . | |
| D. 251,141 | 2/1979 | Carter . | |
| D. 355,009 | 1/1995 | Pagani . | |
| 1,877,820 | 9/1932 | Costello | 473/235 |
| 2,072,682 | 3/1937 | Morgan | 473/515 |
| 2,534,947 | 12/1950 | Bright . | |
| 4,076,240 | 2/1978 | Haddad | 473/563 |
| 4,340,224 | 7/1982 | Staats | 473/563 |
| 5,005,834 | 4/1991 | Ferrari | 473/524 |
| 5,054,784 | 10/1991 | Collins | 473/327 |
| 5,158,296 | 10/1992 | Lee | 473/327 |
| 5,310,185 | 5/1994 | Viollaz et al. . | |
| 5,316,304 | 5/1994 | Yost . | |
| 5,364,103 | 11/1994 | Chen | 473/219 |
| 5,497,993 | 3/1996 | Shan . | |
| 5,529,303 | 6/1996 | Chen | 473/327 |

FOREIGN PATENT DOCUMENTS

| | | | |
|---|---|---|---|
| 2717 | 2/1909 | United Kingdom | 273/78 |

*Primary Examiner*—Sebastiano Passaniti
*Attorney, Agent, or Firm*—LaRiviere, Grubman & Payne

[57] ABSTRACT

A golf club having a hollow body clubhead with a metal mesh clubface and a metal mesh top-of-clubhead design. The design conforms to the shapes of a wood and iron and allows the club to be larger in size and weight than traditional golf club designs. The weight is controlled by modifying the amount of material forming the clubhead. The clubface hitting area for both the wood and iron is increased. The hollow-body allows air to flow through the clubhead, thus reduces air resistance and stabilizes the clubface during the club swing. The speed of the clubhead at impact increases, produces straighter flight of golf ball, and increase the distance the golf ball travels once hit. The design of the clubhead facilitates using a balance of different metals, by example, stainless steel, or other metal alloy. The design facilitates the force of the air to be directed against the inside bottom of the sole to provide better contact with a golf ball and reduce topped shots. The design has less surface contact with the golf ball, and hence there is less spin on the ball, and thus a less tendency to slice, or hook the golf ball. The mesh structure geometry prevents damage to the golf ball, and may be any suitable geometric shape, such as a octagon. The mesh clubface structure complies with the PGA's groove depth requirements of not exceeding 0.200 inches.

18 Claims, 11 Drawing Sheets

GOLF CLUB HAVING ENLARGED HEAD DESIGN FORMED FROM RIGID MESH MATERIAL

TECHNICAL FIELD

The present invention relates to golf clubhead structures. More particularly, the present invention relates to golf clubhead structures formed in traditional shapes of woods and irons and having enlarged clubhead structure. Even more particularly, the present invention relates to enlarged golf clubhead structures formed in traditional shapes of woods and irons and having enlarged clubhead structure facilitated by using mesh in the design of the clubhead.

BACKGROUND ART

Golf clubhead structures are formed to accommodate hitting a golf ball using clubs called woods, irons and putters. The woods are designed and used to initiate playing the game and maximizing the distance the golf ball is hit during teeing-off. The driver, or a 1-wood, is designated the driver and the others in the collection of 2–14 woods being called fairway woods. The irons range from 1–9 irons and are designed for being used to hit a golf ball once a player gets closer to the green where the holes, and or cups are located. The putters are designed and used on or near the putting green for rolling the golf ball instead of lofting the golfball in the air. The shape of the clubhead for a wood is volumetrically larger in comparison to the shape of an iron clubhead. Both the wood and iron have clubheads designed with a clubface having a loft angle. Both the length and loft of a club affect the distance and height of a shot. A 1-wood is designed to facilitate a low trajectory and a long distance, while a 9-iron is designed to facilitate a high trajectory, and a shorter distance. An understanding of the golf club equipment can be found in *"GOLF FORE BEGINNERS, The Fundamentals"*, by Stephen J. Ruthenberg, RGS Publishing, Lansing Mich., 1994, pages 21–29.

Obviously, the overall mass of the club and skill of the player also affects the distance of the shot. The playing of the game is obviously subjective and personalized and continually undergoing improvement to the equipment. The size and weight of the clubs is continually being changed consistent with the rules of the game, as promulgated by the PGA (Professional Golfer's Association). For example, the depth of the grooves on the clubface are controlled such that they do not exceed 0.20 inch. The grooves facilitate a backspin upon impact by the clubface with the golf ball. As improvement to the equipment, the prior art includes teachings of oversized clubheads, such as the "Viper Bite", a trademark of, and commercially available from Carbite Golf, San Diego Calif., "Big Bertha", "Great Big Bertha", trademarks of, and commercially available from Callaway Golf, Carlsbad Calif., and the "King Cobra Ti", a trademark of, and commercially available from Cobra Golf. The enlarged clubheads are provided with appropriate scaled structure to resemble the traditional shapes of the woods and irons clubheads, and weighted to have the appropriate weight to play the sport. The prior art enlarged club head design includes the use of lightweight and harden metal material, such as titanium, for forming the clubhead. However, these prior art enlarged clubheads are seen to be limited in not being able to be designed larger to further improve hitting the golf ball. The prior art does not teach a hollow-body clubhead with a mesh structure clubface and mesh structure top-of-clubhead. In particular, the prior art does not teach forming an enlarged, hollow-body, golf clubhead structure comprising a mesh structure clubface and mesh structure top-of-head formed from a hardened lightweight metal material, such as titanium.

The prior art teaches U.S. patents having golf clubhead with different shapes and designs. These patents include design patents that teach ornamental clubhead designs, namely Des. 355,009, Des. 251,141, and Des. 194,044, and utility patents, namely U.S. Pat. Nos. 2,534,947, 5,310,185, 5,316,304, and 5,497,993. U.S. Pat. No. 5,316,304 teaches golf head structure that does not conform to traditional shapes. U.S. Pat. No. 5,497,993 relates to a golf clubhead constructed with a mesh face panel, but is not hollow to allow the passage of air from the clubface through, and out of the top of the clubhead. U.S. Pat. No. 2,534,947 teaches a sole plate design and a clubface having molded lines. U.S. Pat. No. 5,310,185 teaches a hollow body shell filled with a polyurethane foam for constructing a wood golf clubhead. As stated above, in improving the clubhead design, the prior art patents do not teach a hollow-body, clubhead with a mesh structure clubface and a mesh structure top-of-clubhead to allow the passage of air. In particular, the prior art does not teach forming an enlarged, hollow-body golf clubhead structure comprising a mesh structure clubface and a mesh structure top-of-head for allowing the passage of air and formed from a hardened lightweight metal material, such as titanium. Even more particularly, the prior art does not teach forming an enlarged, hollow-body golf clubhead structure comprising a plurality of strip structure forming a clubface and a plurality of structure forming a top-of-head for allowing the passage of air and formed from a hardened lightweight metal material, such as titanium.

Thus, a need is seen to exist for an enlarged, hollow-body golf clubhead structure comprising a mesh structure clubface and a mesh structure top-of-head to allow the passage of air and formed from a hardened lightweight metal material, such as titanium.

It is therefore a primary object of the present invention to provide an enlarged, hollow-body golf clubhead structure comprising a mesh structure clubface and a mesh structure top-of-head for allowing the passage of air and formed from a hardened lightweight metal material, such as titanium.

DISCLOSURE OF INVENTION

Accordingly, the foregoing primary object is accomplished by providing a golf club having a hollow body clubhead with a mesh clubface and a mesh top-of-clubhead design. The mesh clubface and mesh top-of-clubhead design is adapted to conform to the clubhead shape of a wood and the clubhead shape of an iron. The mesh structure referred to herein not only includes an arrangement of horizontal and vertical strips forming small openings, but also includes an arrangement of parallel strips of material that delineate elongated open spaces between strips. The mesh structure clubhead design allows the club to be larger in volume, by example, for a wood, the volume is larger than 250cc, yet lighter in weight, by example, for a wood the weight is less than 300 grams. The weight of the club is controlled by modifying the amount of material forming the perimeter of the clubface opening and sides of the clubhead which comprise the hollow body of the clubhead. The clubface hitting area is increased, i.e. larger sweet spots than commercially available golf clubs. The hollow-body, mesh clubface structure, and the mesh top-of-clubhead structure allows air to flow through the clubhead, thus reduces air resistance which stabilizes the clubface during the club swing. Also, as a result of the flow of air through the clubhead body, the player has a means for being able to increase the speed of the clubhead, produce straighter flight of golf ball, and thus to increase the distance the golf ball travels once hit. Because of the hollow-body, mesh clubface structure, and the mesh top-of-clubhead structure, the weight of the club becomes a secondary concern which facilitates the use of different metals, by example, stainless steel, aluminum, titanium, or other metal alloy. Also, since the hollow-body, mesh clubface structure, and the mesh top-of-clubhead structure facilitates the entry of air into the clubhead, the force of the air, while eventually exhausted, is directed through the clubface, down against the inside bottom of the sole plate to provide better contact with a golf ball and reduce topped shots. Further, since the clubface is a mesh structure, there is less surface contact with the golf ball, and hence there is less spin on the ball, and thus a less tendency to slice, or hook the golf ball. The material used to form the mesh clubface structure and the mesh top-of-clubhead structure is preferably a hardened metal material having sufficient strength to maintain its form after striking the golf ball. The mesh structure geometry is selected to prevent damage to the golf ball upon the mesh clubface striking the ball, and may include round or flat strands, or other suitable geometric shapes such as a octagon. The mesh clubface structure is designed to comply with the PGA's groove depth requirements of not exceeding 0.200 inches.

Other features of the present invention are disclosed or apparent in the section entitled: "BEST MODE FOR CARRYING OUT THE INVENTION."

BRIEF DESCRIPTION OF DRAWINGS

For fuller understanding of the present invention, reference is made to the accompanying drawing in the following detailed description of the Best Mode of Carrying Out the Present Invention. In the drawings.

Figure 1:
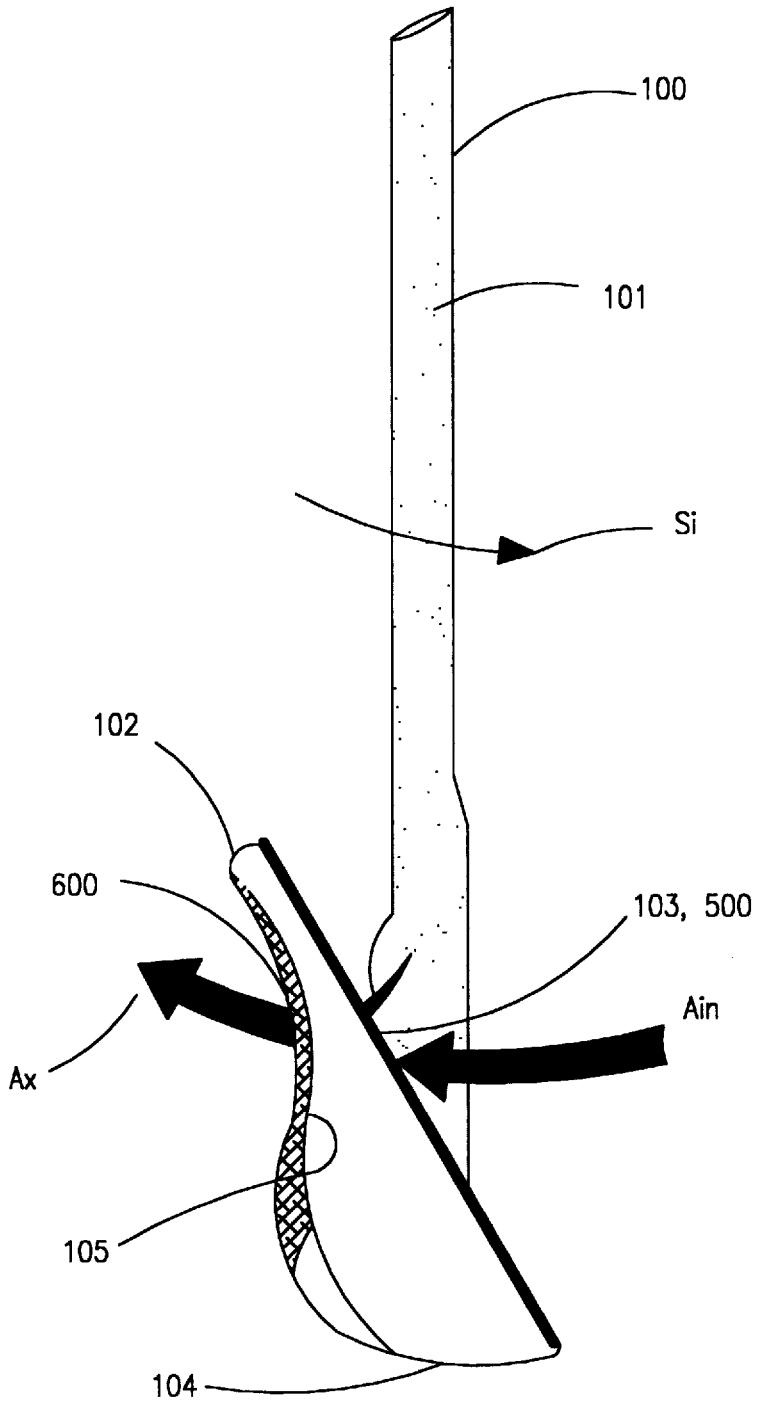
FIG. 1 illustrates a side view of an iron golf club showing entry and exit arrows depicting air flowing through the clubhead body via a clubface and backside portion of the clubhead in accordance with the present invention.

Reference numbers refer to the same or equivalent parts of the present invention throughout the several figures of the drawing.

BEST MODE OF CARRYING OUT THE INVENTION

Figure 2:
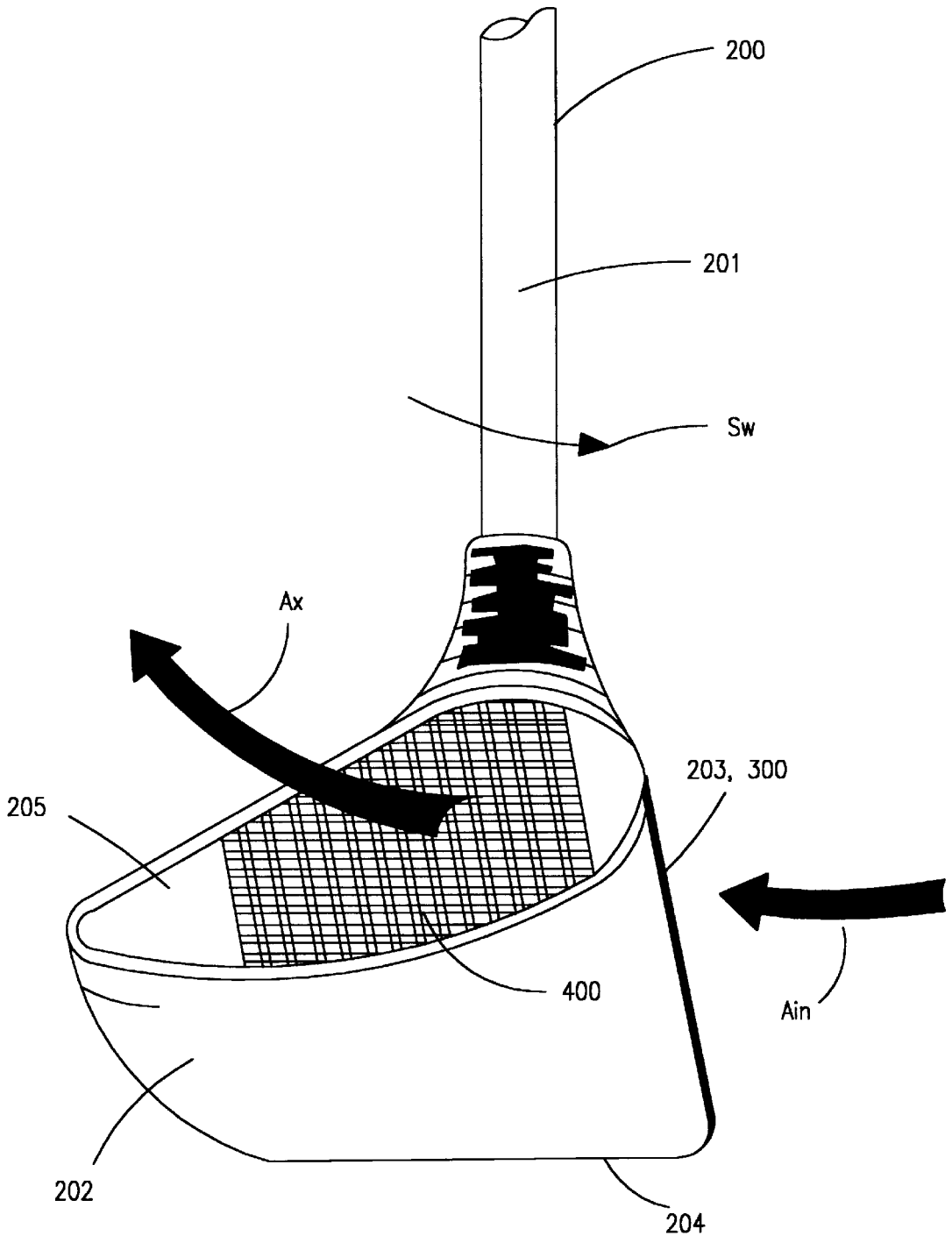
FIG. 2 illustrates a side view of a wood golf club showing entry and exit arrows depicting air flowing through the clubhead body via a clubface and topside portion of the clubhead in accordance with the present invention.
Figure 3:
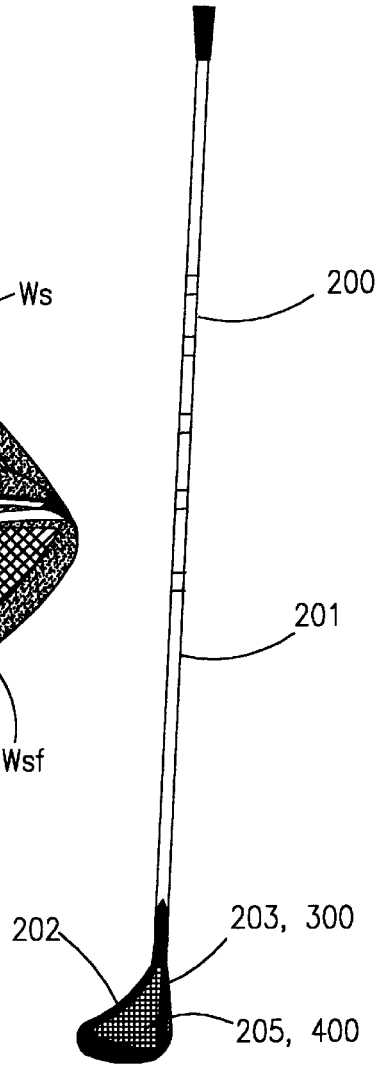
FIG. 3 illustrates a side view of a wood golf club showing the clubhead's clubface and topside portions constructed from a mesh material in accordance with the present invention.
Figures 10, 11:
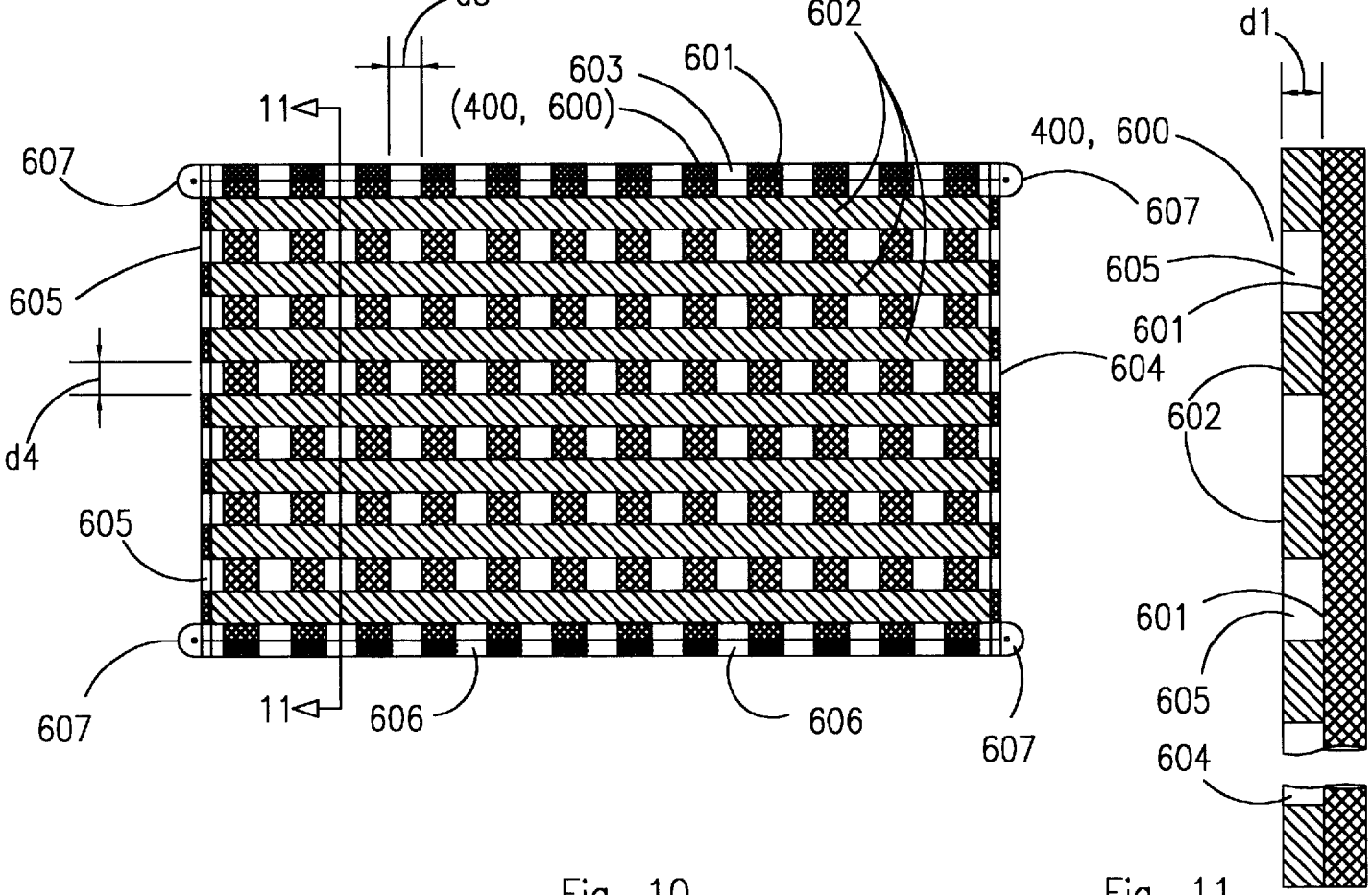
FIG. 10 shows a mesh structure having vertical and horizontal mesh structure members interconnected to each other and having peripheral attachment means for being fixedly attached to a topside window periphery on a wood clubhead and for the backside window periphery on an iron clubhead.
FIG. 11 shows an enlarged side view taken along line 11—11 in FIG. 10 showing the back plane vertical mesh structure members and the outer horizontal mesh structure members, and also showing the depth of the mesh structure, in accordance with the present invention.
Figure 13:
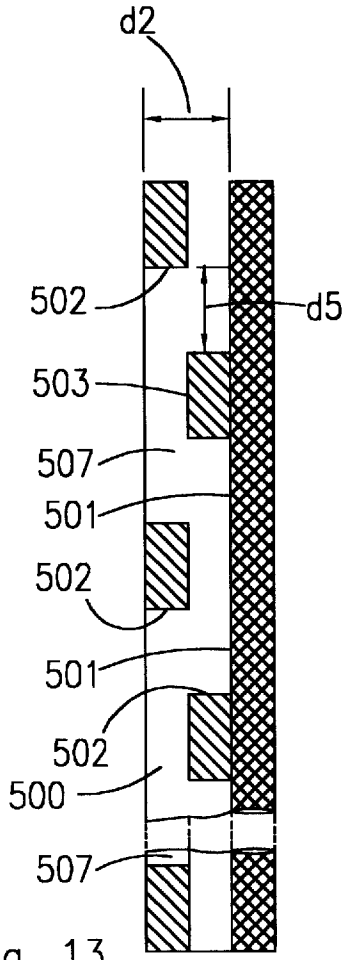
FIG. 13 shows an enlarged side view taken along line 13—13 in FIG. 12 showing the back plane vertical mesh structure members and the frontmost and mid-structure horizontal mesh structure members, and also showing the depth of the mesh structure, in accordance with the present invention.
Figure 12:
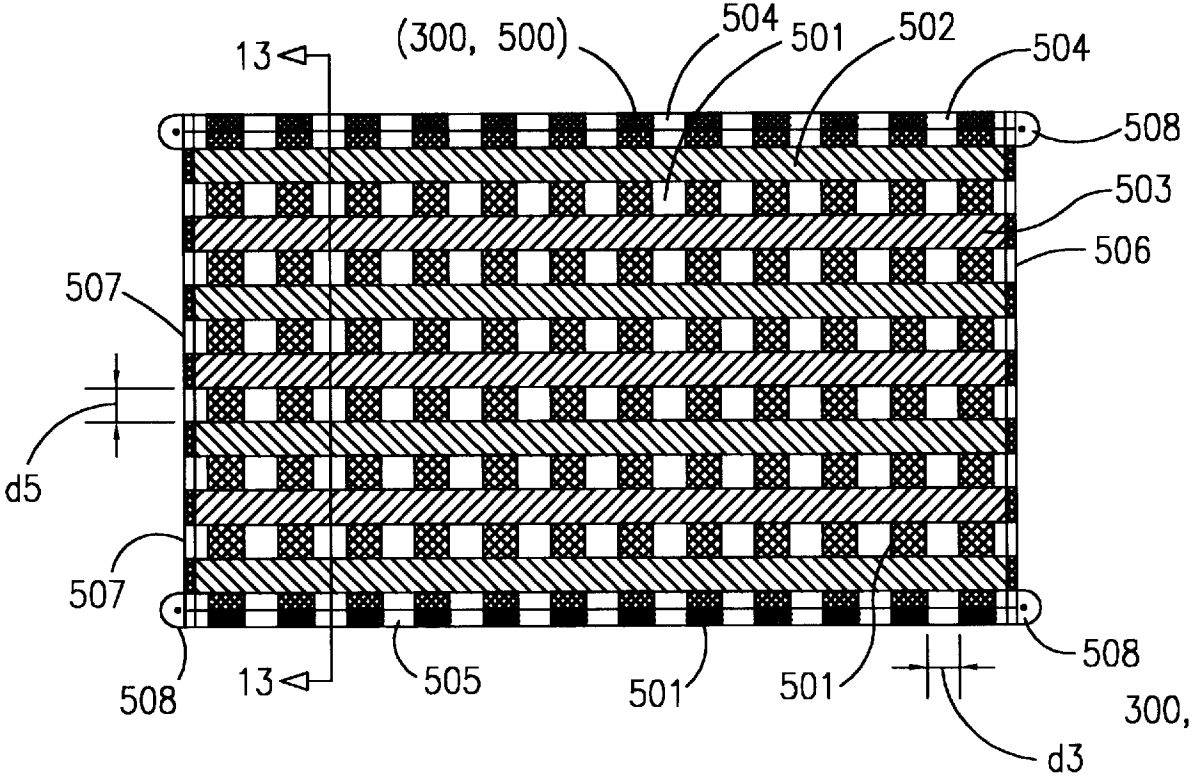
FIG. 12 shows a mesh structure having horizontal frontmost and horizontal mid-structure members and vertical mesh structure members and having peripheral attachment means for being fixedly attached to a flange on a clubface window periphery on a wood clubhead and to a flange on a clubface window periphery on an iron clubhead.

Referring now to FIG. 1 showing a side view of an iron golf club 100 comprising a shaft 101, a clubhead 102, a clubface 103, a sole plate 104 and a backside 105. FIG. 1, in particular, is depicting entry and exit of air, as depicted by arrows Ain and Ax, during use of club 100 as by swinging action Si while playing as game of golf. The entry and exit of air is facilitated by clubhead structure which includes a clubface mesh structure material 500 and a backside mesh structure material 600 adapted to fit the clubhead structure of an iron. Similarly, FIG. 2 shows a side view of a wood golf club 200 comprising a shaft 201, a clubhead 202, a clubface 203, a sole plate 204 and a topside 205. FIG. 2, also in particular, depicts the entry and exit of air, as depicted by arrows Ain and Ax, during use of club 200 as by swinging action Sw while playing as game of golf. As with the iron golf club, the entry and exit of air is facilitated by clubhead structure which includes a clubface mesh structure material 300 and a topside mesh structure material 400 adapted to fit the clubhead structure of a wood. FIG. 3 illustrates a side view of a wood golf club 200 showing the clubhead 202 having clubface 203 and topside portion 205 constructed from mesh material 300, 400 in accordance with the present invention. Similarly, FIG. 7 illustrates a side view of an iron golf club 100 showing clubhead 102 having clubface 103 and backside portion 105 constructed from mesh material 500, 600, also in accordance with the present invention. FIGS. 10, 11, 12 and 13 illustrate a rectangular solid strip configuration of mesh structures 300, 400, 500, and 600. Mesh structures 400, 600 utilize the same two-plane mesh configuration depicted in FIG. 10 for use in backside 105 of irons and topside 205 of woods. Similarly, mesh structures 300, 500 utilize the same three-plane mesh configuration depicted in FIG. 12 for use in clubface 103 of irons and clubface 203 of woods. Although not shown, the geometrical configuration of the strip configuration used on mesh structures 300, 400, 500, and 600, may vary in degree of roundness, shape and depth dimensions to comply with Professional Golf Association's (PGA) constraints regarding clubface grooves and their sharpness of edges, depth and other clubface structure that may impact golf ball's contact, spin and flight. By example, the geometry of the strip of the mesh cross members may be completely round, or other polygon shape, if deemed practical for compliance with PGA's rules, or for effecting adequate golf ball's contact, flight and spin. Further, the physical dimensions d3, d4, d5 shown in FIGS. 10, 11, 12 and 13 of the open grid mesh structure used on the golf clubface, should be carefully controlled such that PGA groove design guidelines are complied with. The groove requirement presently known to applicant are that the depth dimensions, depicted by d1 and d2 in FIGS. 11 and 13, respectively, should not exceed the regulatory groove depth dimension of 0.200 inches. Thus, as an embodiment of the present invention, the iron backside 105 and the wood topside 205 are adapted for attachment of a suitable geometrically shaped portion of the structure 400, 600, depicted in FIGS. 10 and 11, and dimensioned to conform to the size of the clubhead window opening delineated by wood clubhead topside window structure Ws, shown in FIGS. 5 and 6, and iron clubhead backside window structure Iw, shown in FIG. 9. Similarly, the iron clubface 103 and the wood clubface 203 are adapted for attachment of a suitable geometrically shaped portion of the structure 300, 500, depicted in FIGS. 12 and 13, and dimensioned to conform to the clubface window openings delineated by wood clubface window structure Wsf, shown in FIGS. 4 and 5, and iron clubface window structure Iwf, shown in FIG. 8. As shown in FIGS. 10 and 11, mesh structure 400, 600 comprises a plurality of vertical mesh members 601, a plurality of horizontal mesh members 602 that are interspaced and dimensioned by distances d1, d3, d4, such that, minimally, the above discussed 0.200 inch limitation is complied with, even though the dimension pertains to the clubface design. Attachment means on mesh structure 400, 600 for attaching to a flange structure on wood topside window Ws, and to a flange structure on iron backside window Iw, is depicted generally in FIG. 10 as peripheral structure 603, 604, 605 and 606. Peripheral attachment structure 603, 604, 605 and 606 is adapted for terminating respective end portions of the mesh cross members 601, 602, and is provided with mounting holes 607 for attachment to wall flange structure on periphery Ws, and Iw. Similarly, as shown in FIGS. 12 and 13, mesh structure 300, 500 comprises a plurality of vertical mesh members 501, a plurality of offset horizontal mesh members 502, 503 that are interspaced and dimensioned by distances d2, d3, d5, such that the above discussed 0.200 inch for groove depth limitation is complied with for clubface designs. Attachment means on mesh structure 300, 500 for attaching to wood clubface window Wsf, and to iron clubface window Iwf, is depicted generally in FIG. 12 as peripheral structure 504, 505, 506 and 507. Peripheral attachment structure 504, 505, 506 and 507 is adapted for terminating respective end portions of the mesh cross members 501, 502 and 503, and is provided with mounting holes 508 for attachment to wall flange structure on periphery Wsf, and Iwf.

Figure 4:
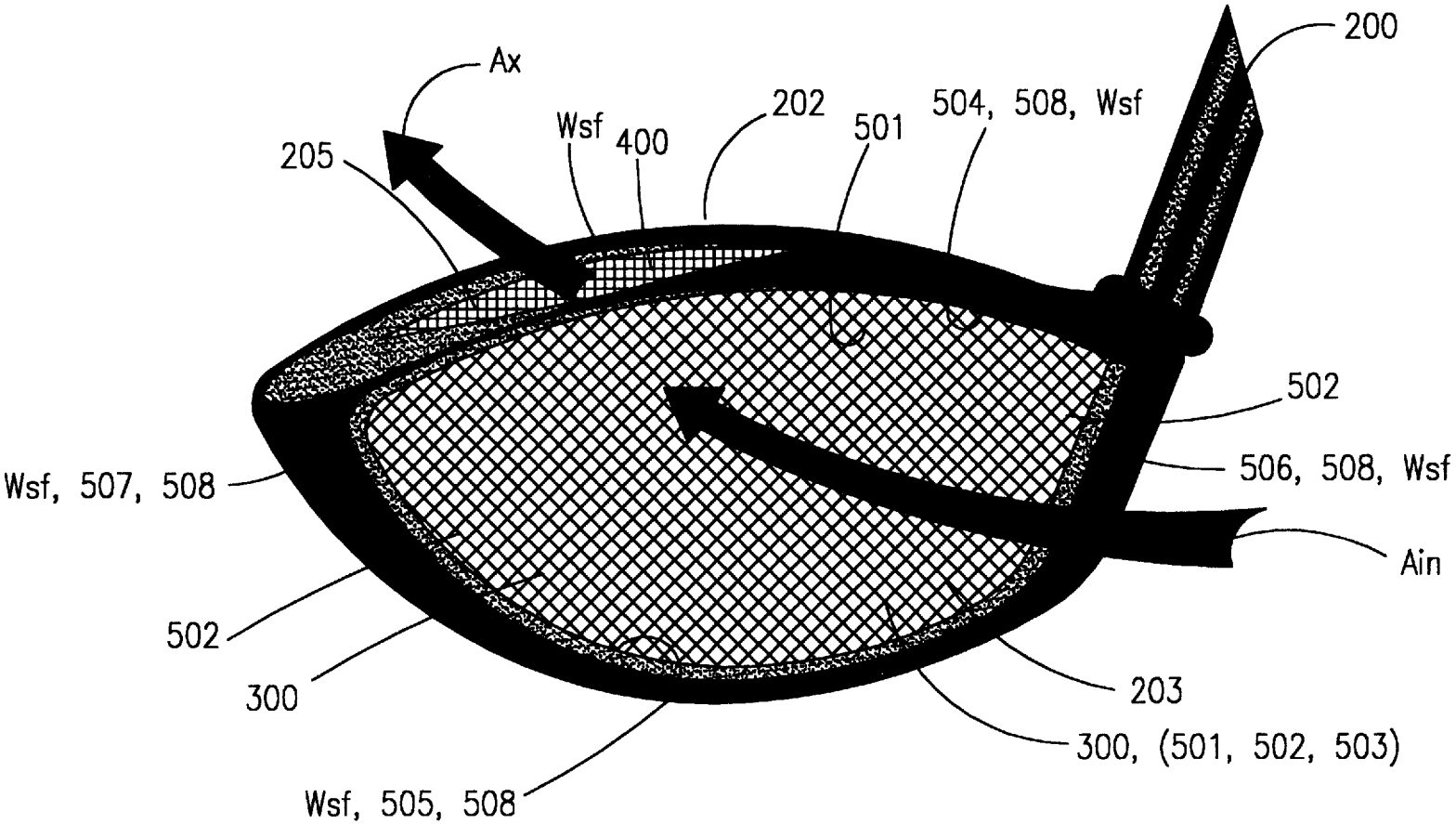
FIG. 4 illustrates a clubface view of a wood clubhead showing the mesh structure on both the clubface and topside portion of the clubhead in accordance with the present invention, and also showing entry and exit arrows depicting air flowing through the clubhead body via the clubface and topside portion of the clubhead, also in accordance with the present invention.
Figure 5:
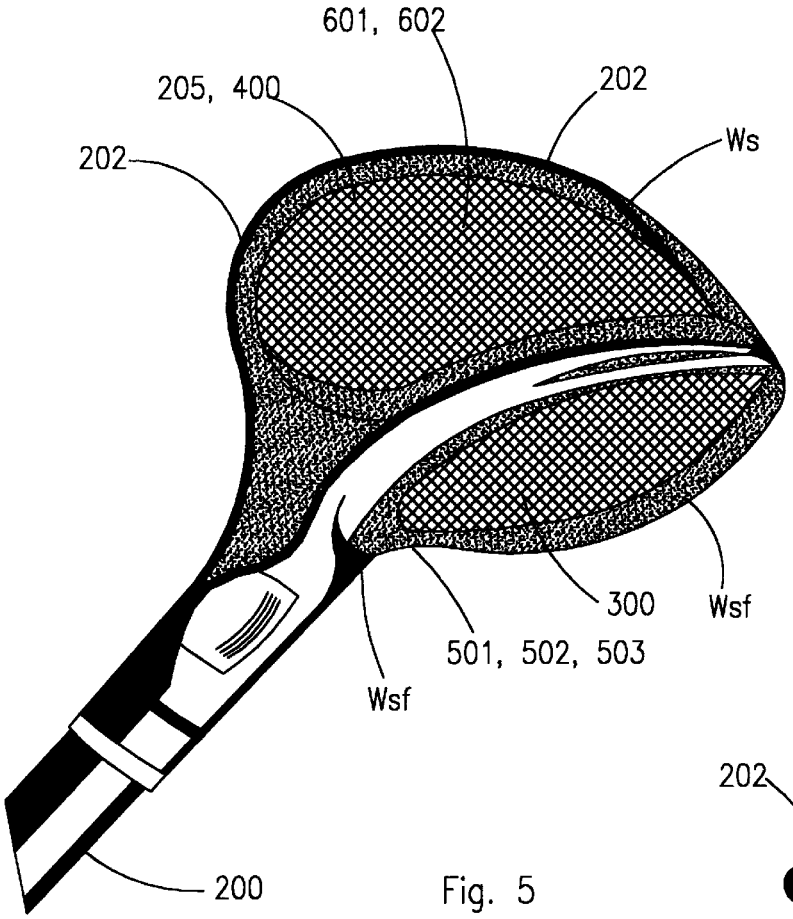
FIG. 5 illustrates a view of another wood clubhead showing the mesh structure on both the topside portion and clubface portion of the clubhead in accordance with the present invention.
Figure 6:
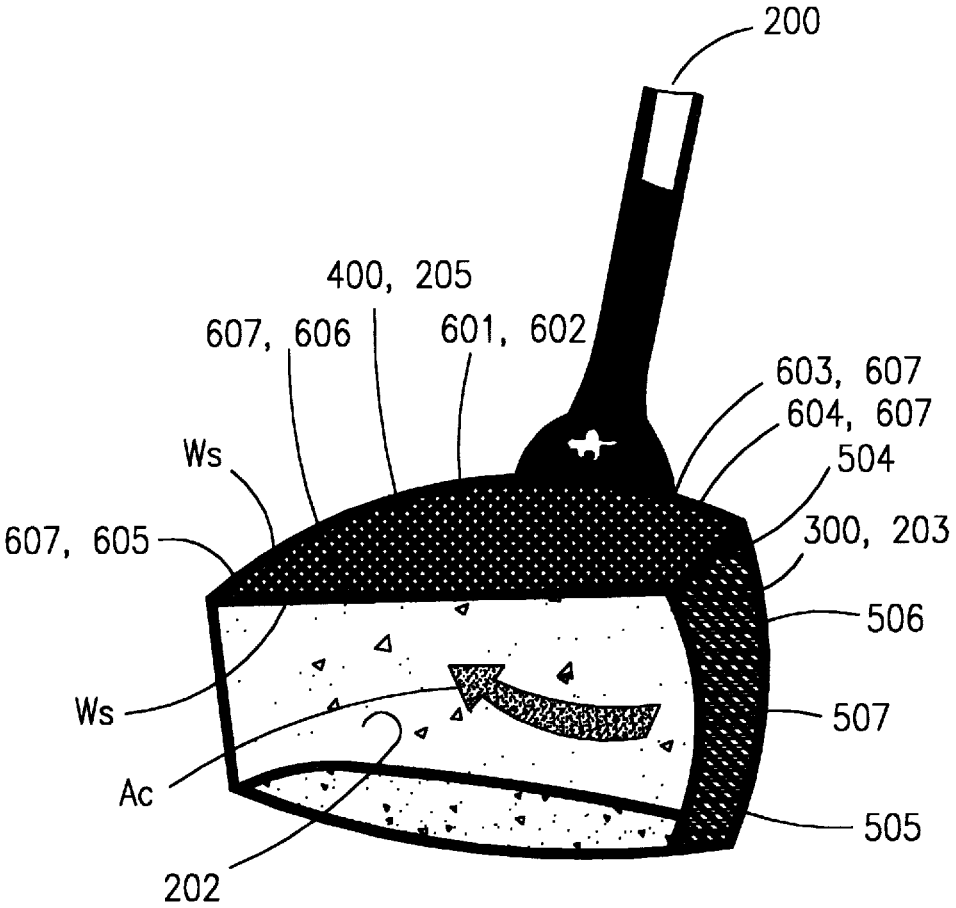
FIG. 6 illustrates a cutaway view of a wood clubhead showing the mesh structure on both the clubface and topside portion of the clubhead in accordance with the present invention, and also showing an internal arrow depicting air flowing within the clubhead body subsequent to entry via the clubface portion of the clubhead, also in accordance with the present invention.
Figure 7:
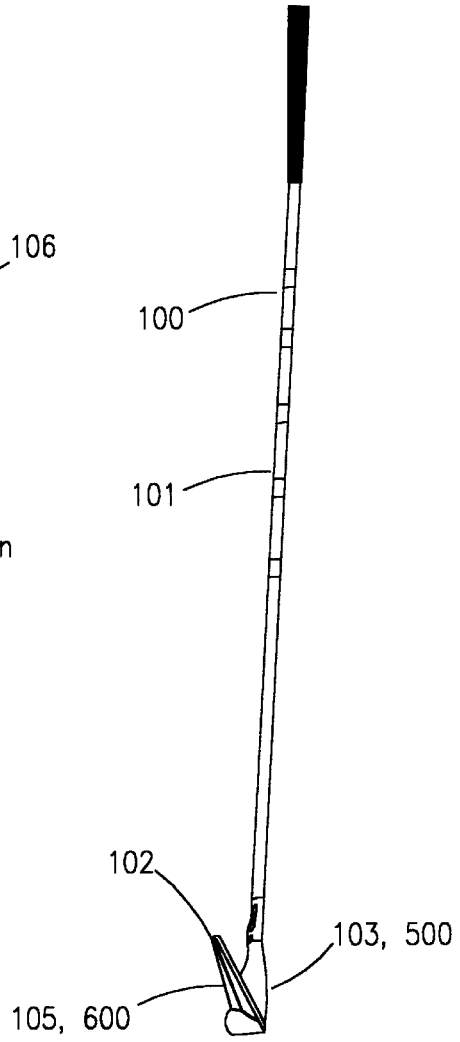
FIG. 7 illustrates a side view of an iron golf club showing the clubhead's clubface and backside portions constructed from a mesh material in accordance with the present invention.

FIGS. 4, 5, and 6 show the foregoing mesh structures 300, 400 in use on a wood golf clubhead 202. FIG. 6, in particular, illustrates a cutaway view of a wood clubhead 202 showing mesh structure 300 on clubface 203 and mesh structure 400 on topside portion 205. FIG. 6 also shows an internal arrow Ac depicting air flowing within a hollow clubhead body 202, subsequent to entry of air via mesh clubface portion 203. The hollow body construction of wood clubhead 202 facilitates control of the weight of golf club 200. FIGS. 4 and 6 illustrates clubface 203 with mesh structure 300 attached to the clubface periphery Wsf. As seen in FIGS. 4 and 6, mesh structure 300 has been adapted such that mesh cross members 501, 502, and 503, and peripheral structure 504, 505, 506 and 507, with securement holes 508, are shaped to conform to the shape of clubface opening Wsf for attachment thereto. Attachment may be effected by use of hardware such as an anchor screw through securement holes 506, or by use of a strong bonding chemical adhesive substance. FIG. 4 also shows entry and exit arrows Ain and Ax depicting air flowing through the clubhead body via clubface 203 and topside portion 205 of the clubhead, in accordance with the present invention. FIG. 5 illustrates a wood clubhead 202 with mesh structure 300 attached to the clubface periphery Wsf and with mesh structure 400 attached to the wood's clubhead topside window periphery Ws. Mesh structure 300 is shown with mesh cross members 501, 502, and 503 and mesh structure 400 is shown with mesh cross members 601, 602. FIG. 6 shows mesh structure 400 attached to topside window structure Ws. Mesh structure 400 has been adapted such that mesh cross members 601 and 602, and peripheral structure 603, 604, 605 and 606, with securement holes 607, are shaped to conform to the shape of clubhead topside opening Ws for attachment thereto.

Figure 8:
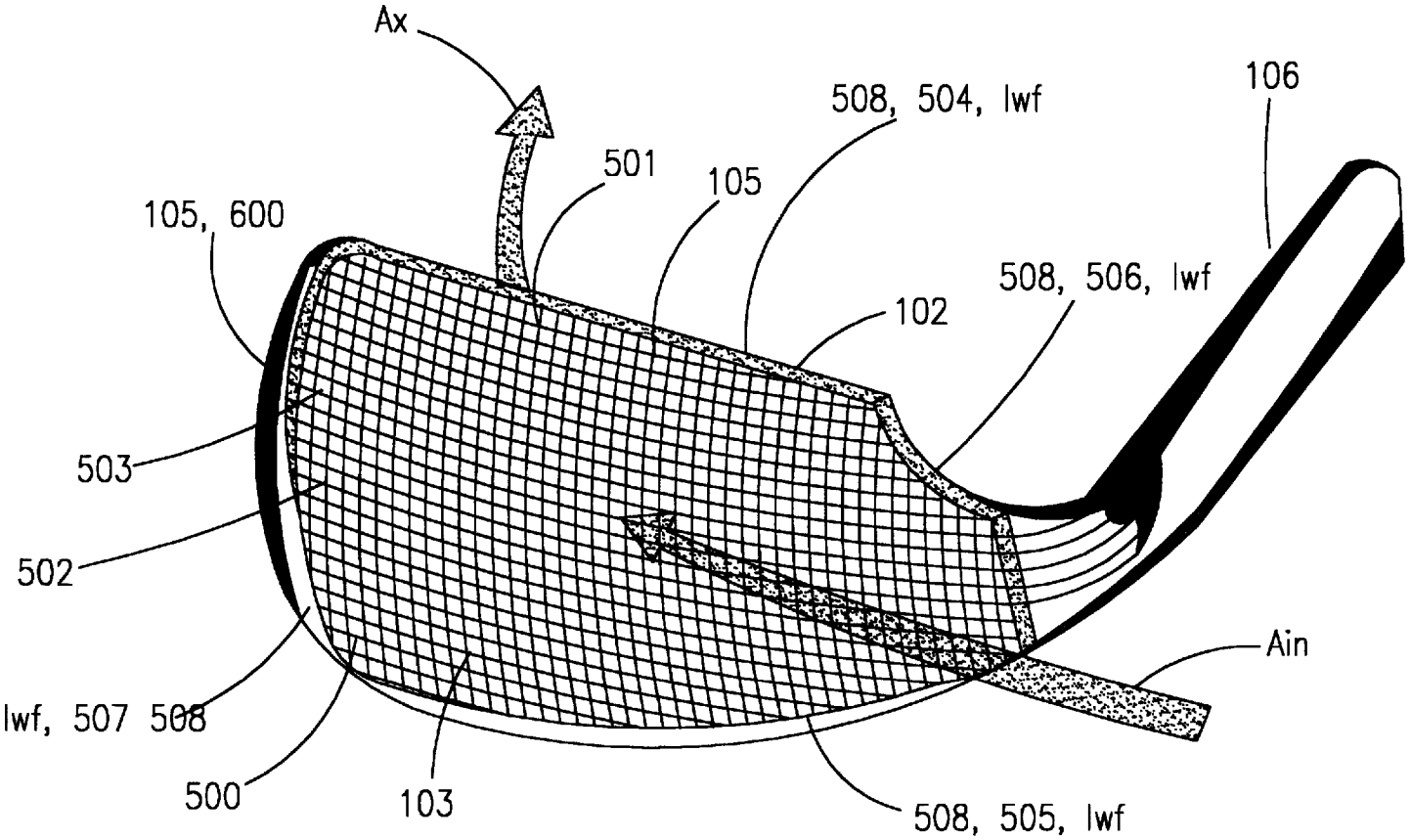
FIG. 8 illustrates a clubface view of an iron clubhead showing the mesh structure on clubface portion of the clubhead in accordance with the present invention, and also showing entry and exit arrows depicting air flowing through the clubhead body via the clubface and backside portion of the clubhead, also in accordance with the present invention.
Figure 9:
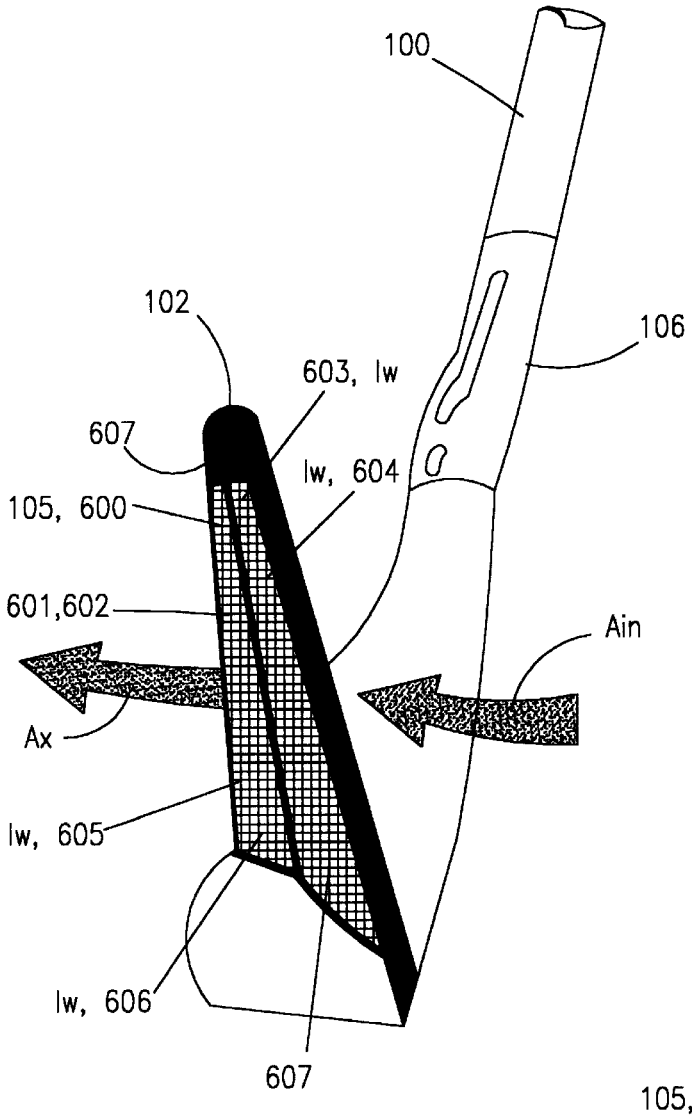
FIG. 9 illustrates a backside view of an iron clubhead showing the mesh structure on clubface portion of the clubhead in accordance with the present invention, and also showing entry and exit arrows depicting air flowing through the clubhead body via the clubface and backside portion of the clubhead, also in accordance with the present invention.

FIGS. 8, and 9 show the mesh structures 500, 600 in use on an iron golf clubhead 102. As with the wood clubhead 202, iron clubhead is formed having a hollow body construction for facilitating the flow of air as depicted by arrows Ain and Ax. Also, as with the hollow body construction of clubhead 202, hollow body of clubhead 102 also facilitates control of the weight of iron golf club 100. FIGS. 8 illustrates clubface 103 with mesh structure 500 attached to the clubface periphery Iwf. FIG. 8 shows mesh structure 500 adapted such that mesh cross members 501, 502, and 503, and peripheral structure 504, 505, 506 and 507, with securement holes 508, are shaped to conform to the shape of clubface opening Iwf for attachment thereto. As with the wood clubface, attachment may be effected by use of hardware such as an anchor screw through securement holes 508, or by use of a strong bonding chemical adhesive substance. FIGS. 8 and 9 also shows entry and exit arrows Ain and Ax depicting air flowing through the clubhead body via clubface 103 and backside portion 105 of the clubhead, in accordance with the present invention. FIG. 9 illustrates an iron clubhead's backside 105 with mesh structure 600, and associated mesh cross members 601, 602, attached to flange structure on backside periphery Iw by use of peripheral structure 603, 604, 605 and 606, with securement holes 607.

Figure 14:
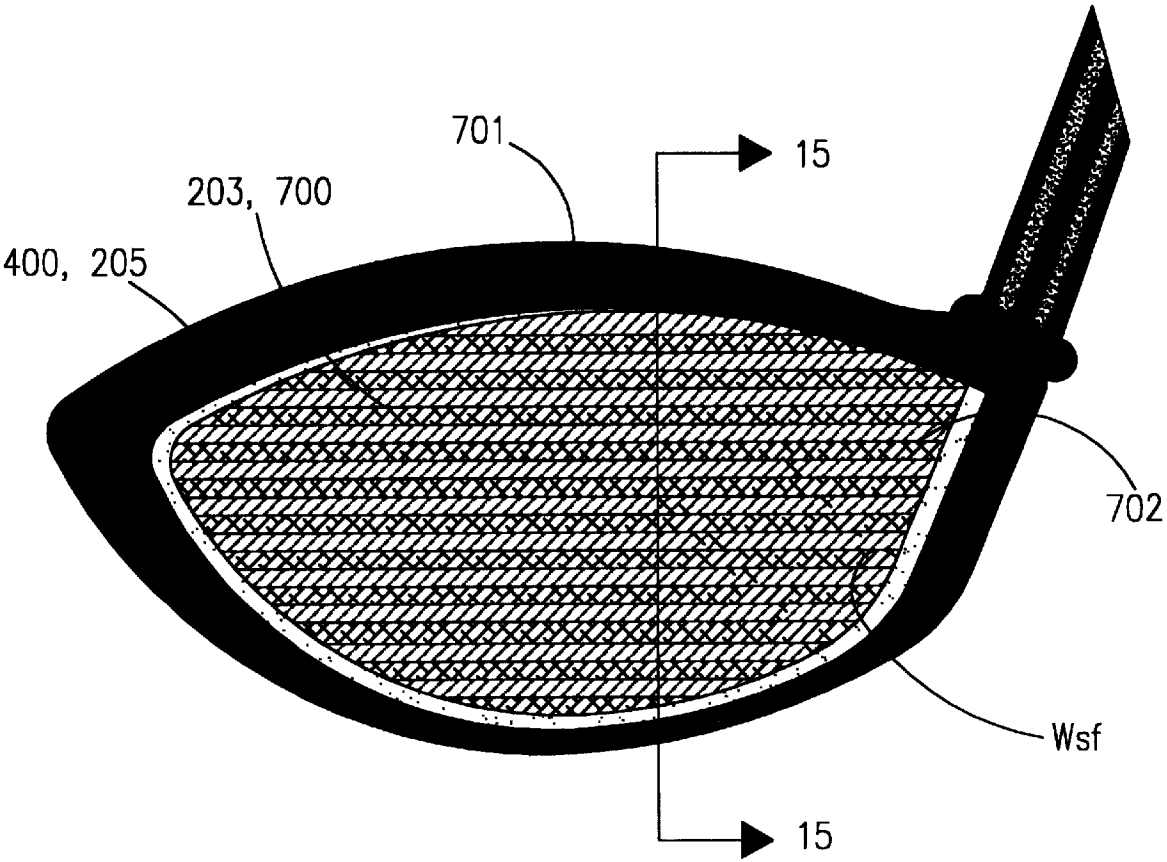
FIG. 14 shows alternative mesh arrangement consisting of frontmost and back horizontal strip structural members forming a clubface by peripheral attachment to a flange on a clubface window periphery of a wood clubhead.
Figure 16:
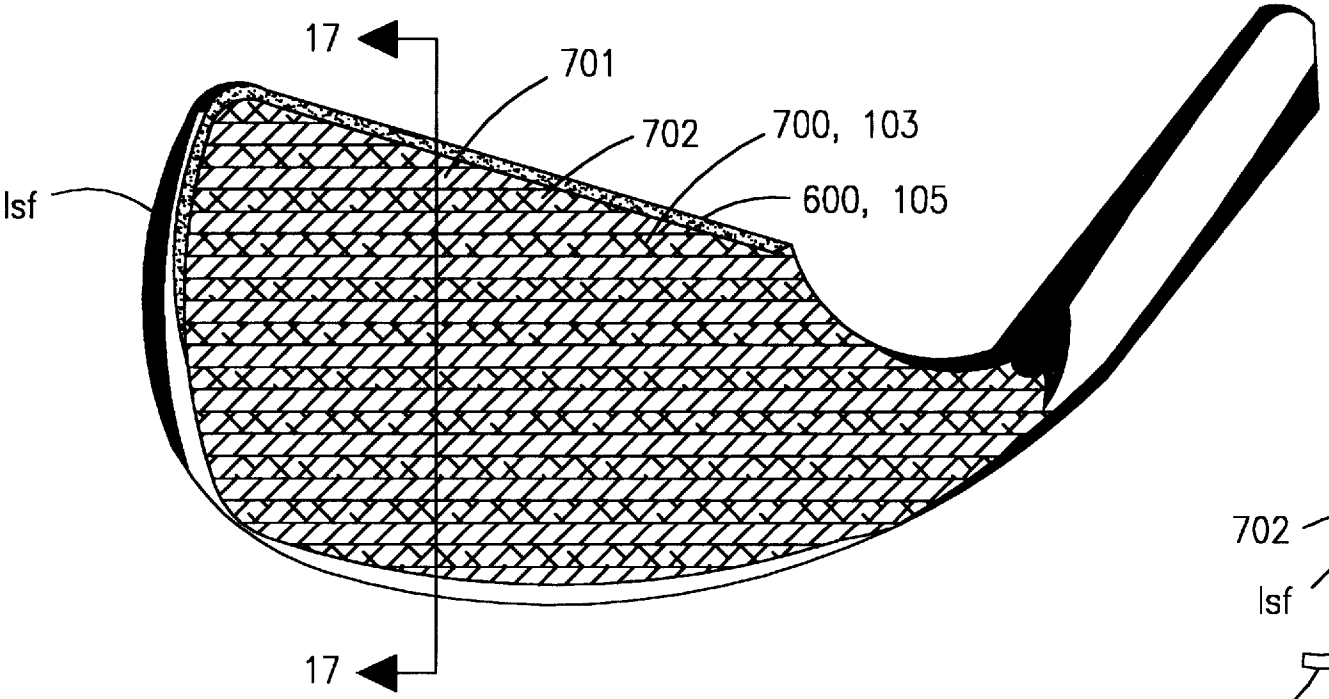
FIG. 16 shows alternative mesh arrangement consisting of frontmost and back horizontal strip structural members forming a clubface by peripheral attachment to a flange on a clubface window periphery on an iron clubhead.

FIGS. 14 and 16 show alternative mesh arrangement 700 consisting of a back horizontal strip structure member 701, and a frontmost, clubface side, horizontal strip structure member 702. Mesh arrangement 700 with, respective strip members 701, 702 are sized to conform to fit onto a clubface window flange periphery Wsf, Isf of respective wood and iron clubfaces 203, 103. The material used to form the mesh clubface structure 700, as with mesh structures 300, 400, 500, and 600, is preferably a hardened metal material having sufficient strength to maintain its form after striking the golf ball. The geometry of strip members 701, 702 is selected to prevent damage to the golf ball upon the striped clubface surface striking the ball, and may include round or flat strips, or other suitable geometric shapes such as a octagon. The mesh clubface structure is designed such that a depth dimension d6, d7 complies with the PGA's groove depth requirements of not exceeding 0.200 inches.

Figure 15:
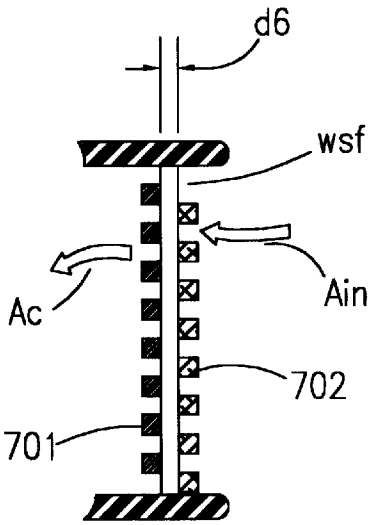
FIG. 15 shows a partial side view taken along line 15—15 in FIG. 14 showing an offset attachment to window periphery flange structure of the frontmost and back horizontal strip structure members to effect a groove depth dimension regulatory requirement, in accordance with the present invention.
Figure 17:
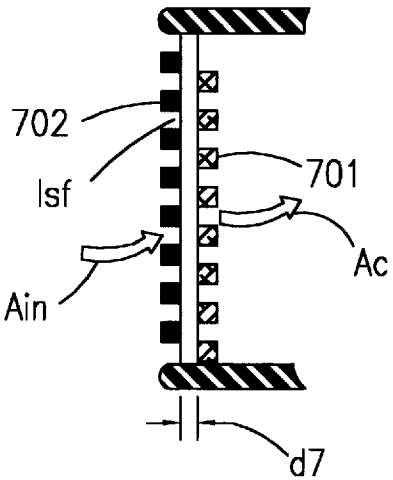
FIG. 17 shows a partial side view taken along line 17—17 in FIG. 16 showing an offset attachment to window periphery flange structure of the frontmost and back horizontal strip structural members to effect a groove depth dimension regulatory requirement, in accordance with the present invention.

FIG. 15 shows the offset attachment to window periphery flange structure Wsf of the frontmost and back horizontal strip structural members 701, 702 to effect a depth dimension d6 which does not exceed the groove depth dimension regulatory requirement. Similarly, FIG. 17 shows the offset attachment to window periphery flange structure Isf of the frontmost and back horizontal mesh structure members 701, 702 to effect a depth dimension d7 which does not exceed the groove depth dimension regulatory requirement.

The advantages of using mesh structure 700 for forming a clubface surface on woods and irons are the same as with the advantages previously discussed when using mesh structures 300, 500 for forming clubface surfaces on woods and irons. Additionally, the mesh structure 500 and 700 may be used to form clubface surfaces on irons without iron clubheads having exhaust structures.

The present invention has been particularly shown and described with respect to certain preferred embodiments of features thereof. However, it should be readily apparent to those of ordinary skill in the art that various changes and modifications in form and detail may be made without departing from the spirit and scope of the invention as set forth in the appended claims. The invention disclosed herein may be practiced without any element which is not specifically disclosed herein.

What is claimed is:

1. A golf club apparatus said apparatus comprising:

a hollow clubhead frame, said frame having a first window structure, said first window structure delineating a first flange structure for receiving a clubface structure, a clubface structure comprising a first mesh structure having openings sized for facilitating entry of air, and being sized and shaped to conform and attach to said first flange structure:

a second window structure, said second window structure delineating a second flange structure for receiving an exhaust clubhead structure, an exhaust clubhead structure comprising a second mesh structure having openings sized for exhausting air, and being sized and shaped to conform and attach to said second flange structure; and said clubhead frame being constructed from metallic material selected from a group consisting of aluminum, stainless steel, and titanium.

2. A golf club apparatus as described in claim 1, wherein:

said golf club apparatus comprises a wood golf club.

3. A golf club apparatus as described in claim 1, wherein:

said golf club apparatus comprises an iron golf club.

4. A golf club apparatus as described in claim 2, wherein:

said clubface structure and said exhaust clubhead structure being constructed from metallic material selected from a group consisting of aluminum, stainless steel, and titanium.

5. A golf club apparatus as described in claim 4, wherein:

said golf club apparatus comprises a wood golf club.

6. A golf club apparatus as described in claim 4, wherein:

said golf club apparatus comprises an iron golf club.

7. A golf club apparatus, said apparatus comprising:

a hollow clubhead frame, said frame having a first window structure and a second window structure, said first window structure delineating a first flange structure for receiving a clubface structure, said second window structure delineating a second flange structure for receiving an exhaust clubhead structure;

a clubface structure comprising a first mesh structure having openings sized for facilitating entry of air, and being sized and shaped to conform and attach to said first flange structure; and an exhaust clubhead structure comprising a second mesh structure having openings sized for exhausting air, and being sized and shaped to conform and attach to said second flange structure, said clubhead frame, said clubface structure, said exhaust clubhead structure being constructed from metallic material selected from a group consisting of aluminum, stainless steel, and titanium.

8. A golf club apparatus as described in claim 7, wherein:

said golf club apparatus comprises a wood golf club.

9. A golf club apparatus as described in claim 7, wherein:

said golf club apparatus comprises an iron golf club.

10. A golf club apparatus, said apparatus comprising:

a hollow clubhead frame, said frame having a first window structure and a second window structure, said first window structure delineating a first flange structure for receiving a clubface structure, said second window structure delineating a second flange structure for receiving an exhaust clubhead structure;

a clubface structure comprising a first mesh structure having openings sized for facilitating entry of air, and being sized and shaped to conform and attach to said first flange structure, said first mesh structure comprising a first mesh material arrangement formed such that a depth dimension associated with a mesh opening is less than or equal to a regulatory depth dimension for grooves on a clubface; and an exhaust clubhead structure comprising a second mesh structure having openings sized for exhausting air, and being sized and shaped to conform and attach to said second flange structure, said clubhead frame, said clubface structure, said exhaust clubhead structure being constructed from metallic material selected from a group consisting of aluminum, stainless steel, and titanium.

11. A golf club apparatus as described in claim 10, wherein:

said first mesh structure being a plurality of offset horizontal strip members geometrically shaped using a design selected from a group of geometric designs consisting of square, rectangular, circular and octagon designs.

12. A golf club apparatus as described in claim 11, wherein:

said golf club apparatus comprises a wood golf club.

13. A golf club apparatus as described in claim 11, wherein:

said golf club apparatus comprises an iron golf club.

14. A golf club apparatus as described in claim 10, wherein:

said first mesh material arrangement comprises a three plane mesh arrangement including a first plane consisting of a set of vertical mesh members, a second plane consisting of a first set of horizontal mesh members, and third plane consisting of a second set of horizontal mesh members, said first, second, and third planes being interconnected via periphery structure.

15. A golf club apparatus as described in claim 14, wherein:

said second mesh structure comprises a second mesh material arrangement configured as a two plane mesh arrangement including a first plane consisting of a set of vertical mesh members, and a second plane consisting of a set of horizontal mesh members, said first and second planes being interconnected via periphery structure.

16. A golf club apparatus as described in claim 15, wherein:

said first mesh material arrangement being formed having cross mesh members geometrically shaped using a design selected from a group of geometric designs consisting of square, rectangular, circular and octagon designs; and said golf club apparatus comprises a wood golf club.

17. A golf club apparatus as described in claim 15, wherein:

said first mesh structure being formed having cross mesh members geometrically shaped using a design selected from a group of geometric designs consisting of square, rectangular, circular and octagon designs; and said golf club apparatus comprises an iron golf club.

18. A method for enlarging a clubhead on a golf club, said method comprising the steps of:

(a) providing a hollow clubhead frame, said frame having a first window structure and a second window structure, said first window structure delineating a first flange structure for receiving a clubface structure, said second window structure delineating a second flange structure for receiving an exhaust clubhead structure;

(b) providing a clubface structure comprising a first mesh structure having openings sized for facilitating entry of air, and being sized and shaped to conform and attach to said first flange structure, said first mesh structure comprising a first mesh material arrangement formed such that a depth dimension associated with a mesh opening is less than or equal to a regulatory depth dimension for grooves on a clubface;

(c) providing an exhaust clubhead structure comprising a second mesh structure having openings sized for exhausting air, and being sized and shaped to conform and attach to said second flange structure; and (d) forming said clubhead frame, said clubface structure, said exhaust clubhead structure from metallic material selected from a group consisting of aluminum, stainless steel, and titanium.

* * * * *